United States Patent [19]

Hoen et al.

[11] Patent Number: 4,522,436

[45] Date of Patent: Jun. 11, 1985

[54] SPRING-LOADED TOGGLE LATCH

[75] Inventors: Cuyler Hoen, Rennsselaer; Frederick J. Pufpaff, Loudonville, both of N.Y.

[73] Assignee: Simmons Fastener Corporation, Albany, N.Y.

[21] Appl. No.: 482,576

[22] Filed: Apr. 6, 1983

[51] Int. Cl.[3] ..... E05C 19/14

[52] U.S. Cl. ..... 292/113; 292/DIG. 49; 292/DIG. 60

[58] Field of Search ..... 292/113, 247, DIG. 49, 292/DIG. 60; 267/179, 155

[56] References Cited

U.S. PATENT DOCUMENTS

| | | | |
|---|---|---|---|
| 1,105,963 | 8/1914 | Clem | 292/79 X |
| 1,876,865 | 9/1932 | Dean | 267/155 X |
| 2,548,367 | 4/1951 | Harris | 292/113 |
| 2,820,995 | 1/1958 | Schlueter | 292/111 X |
| 3,126,072 | 3/1964 | Johansson | 267/155 |
| 3,476,424 | 11/1969 | Erickson | 292/113 X |
| 3,830,705 | 8/1974 | Dewegeli | 292/247 X |
| 3,847,423 | 11/1974 | Gley | 292/113 |

*Primary Examiner*—Gary L. Smith
*Assistant Examiner*—Russell W. Illich
*Attorney, Agent, or Firm*—Eliot S. Gerber

[57] ABSTRACT

A fastener to removably secure two panels consists of a spring-loaded toggle latch (catch unit) on one panel and a keeper plate (strike) with a keeper lip on the other panel. The toggle latch comprises a pivot bracket with a flat base plate and opposite upstanding side ears, a pivotable operating lever (handle) and a pivotable hasp member (draw bar) having a downwardly turned lip at its free end to engage the keeper lip. The three members of the toggle latch are solely joined by left and right single-turn coiled torsion springs which spring-load the hasp member. In one embodiment the flat base plate of the pivot bracket has two openings, each with a series of staggered indentations forming pairs of indentations, which indented pairs are differently spaced from the edge of its panel, to permit adjustable mounting of the pivot bracket on its panel.

11 Claims, 8 Drawing Figures

SPRING-LOADED TOGGLE LATCH

BACKGROUND OF THE INVENTION

The present invention relates to industrial fasteners and more particularly to an over-center toggle latch.

Latches to join two members, for example, two panels, so that they may be separated and rejoined, have been developed over many years. Such latches are commonly used to secure container lids, trunk lids, panel doors and for industrial applications. A toggle latch provides the advantage of being relatively secure against accidental opening after it has been closed.

At the present time toggle latches are generally constructed with a bracket, an operating lever, a pivotable hasp (drawbar), an internal spring means if spring-loaded, and one or two pins pivotally mounting the lever and movable hasp on the bracket. That construction is relatively complex and expensive.

A relatively simple fastener is shown in U.S. Pat. No. 4,049,301 to Peter Schenk which is entitled "Toggle Latch". The operating lever (handle) is pivotally mounted on the bracket by a first pin and the drawbar is mounted to the lever by a second pin. The drawbar is spring metal which is corrugated to provide spring action.

In U.S. Pat. No. 4,025,094 entitled "Overcenter Latch" a handle member is pivoted on one pin and a tension member pivots on a second pivot pin. In U.S. Pat. No. 3,026,133 to Swanson, the handle member pivots on a first pin, a coil spring in a housing pivots on a second pin on the handle member, and the movable hasp (link) pivots on a third pin on the handle member. Two patents (U.S. Pat. Nos. 3,847,423 and 4,243,255) to Rexnord, Inc. show the use of an internal coil spring in a toggle latch, both of which are relatively complex. U.S. Pat. No. 4,065,161, entitled "Container Or Panel Clamp", shows a simpler device in which the movable hasp (drawhook) is a wire member with a spring loop along its length. U.S. Pat. No. 2,820,995 to E. Schlueter, entitled "Spring Loaded Lock Fastener", shows a slidable hasp pivotally mounted, and spring-loaded, by spring wire pivot members. It is not a toggle latch, but rather operates by a cam mechanism.

OBJECTIVES AND FEATURES OF THE INVENTION

It is an objective of the present invention to provide an over-center toggle latch which, when the latch is locked, requires an initial larger force to unlock it, providing a securely locked arrangement.

It is a further objective of the present invention to provide such a toggle latch which will use relatively fewer parts, so as to be economical to manufacture and which, because it has fewer parts, is less likely to fail.

It is a still further objective of the present invention to provide such a toggle latch in which the pivotable hasp is spring-loaded to allow for errors in the location of the keeper plate or bracket member and to more securely lock the latch when it is closed.

It is a still further objective of the present invention to provide such a toggle latch that will, without alteration, serve equally well in applications in which spring-loading is not needed or is undesirable.

It is a still further objective of the present invention to provide such a toggle latch in which the spring-loading does not start from zero to some usably sufficient force, but rather the spring-loading starts at the minimum force that may be desired and increases by some amount before going positive.

It is a still further objective of the present invention to provide such a toggle latch which, because of its spring-loaded mounting and when used with an optional adjustable base plate, permits stepless adjustment of position over a relatively wide range.

It is a feature of the present invention that a fastener is preferably assembled from sheet metal parts. The fastener removably joins first and second panels. A fixed keeper member is adapted to be connected to the first panel and a toggle latch is adapted to be connected to the second panel.

The toggle latch includes a bracket member having a base plate and opposed upraised side portions (ears), each side portion having a through bearing hole. A lever member (handle member) is pivotally mounted on the bracket member (between its side portions) and has a pivot means, preferably a pair of bearing holes, near one of its ends and a pair of elongated apertures (slots) suitably located somewhat farther from the same end.

The toggle latch also includes a pivotable hasp member having grasp means, such as a lip, near one end to removably grasp the keeper member and having pivot means near its opposite end. The pivot means is preferably a tunnel bore formed by a turned-back portion at the end of the hasp. A left coiled torsion spring member and a right coiled torsion spring member each has a first inwardly extended spring arm captured in the pivot means of the lever member and the bearing holes of the bracket member and a second inwardly extended spring arm extending through the elongated second aperture (slot) in the lever and captured in the pivot means (tunnel bore) of the pivotable hasp. The spring members pivotally mount the lever and pivotable hasp to the bracket member.

BRIEF DESCRIPTION OF THE DRAWINGS

Other objectives and features of the present invention will be apparent from the following detailed description taken in conjunction with the accompanying drawings.

In the drawings.

DETAILED DESCRIPTION OF THE INVENTION

As it appears there is no accepted terminology in respect to the parts of a toggle latch, either within the industry or in the patents which are discussed above, some names used in the following description will be followed by a parenthesis, providing an alternative name which may be used for the same part.

Figure 1:
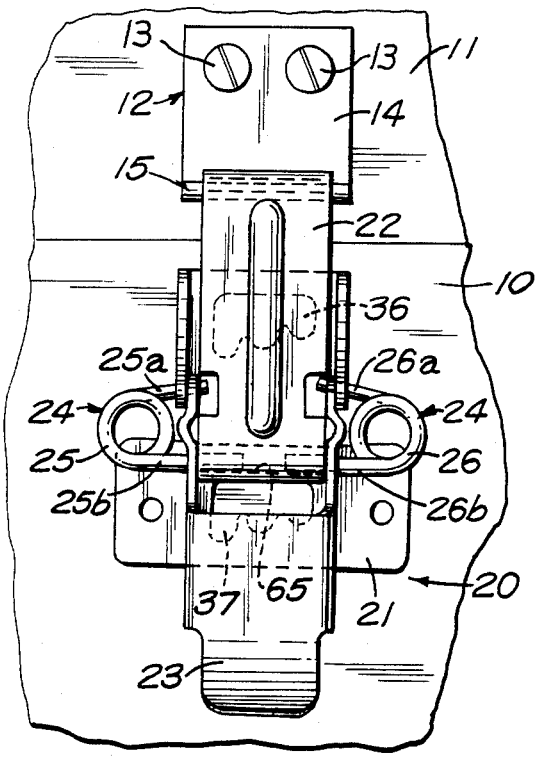
FIG. 1 is a top plan view of the assembled fastener of the present invention.
Figure 8:
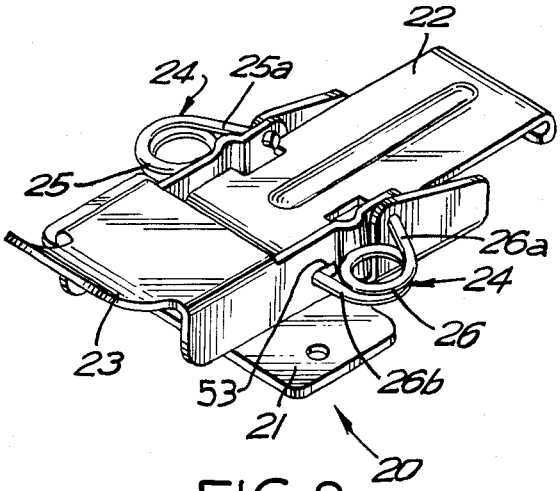
FIG. 8 is a perspective view of the toggle latch of the present invention.

As shown in FIGS. 1 and 8, the present invention relates to a toggle latch which may be used to pull together the panels 10 and 11 and to lock the panels together until it is desired that they be released. The panels 10 and 11, for example, may be the side wall and the lid of a container.

A keeper member 12 (strike) is attached to the panel 11 by the screws 13 or by rivets or welding. The keeper member 12 includes, as integral portions, a flat keeper plate 14, through which the screws 13 protrude, and an upraised lip 15. The lip 15 provides the female jointure of the fastener. Preferably keeper member 12 is formed from sheet metal.

The toggle latch assembly 20 is attached to the opposite panel 10 and includes as portions of the assembly, a bracket 21, a pivotable hasp 22, an operating lever 23 and a pair of springs 24.

Figure 2:
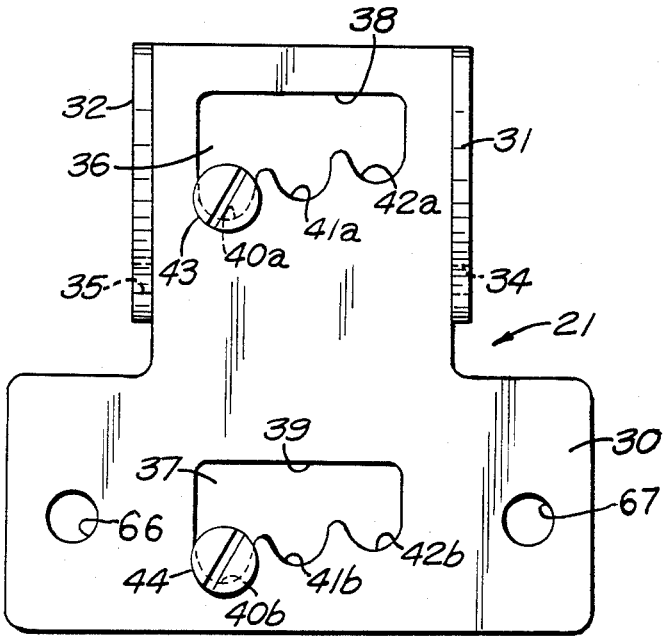
FIG. 2 is a top plan view of the bracket member.
Figure 3:
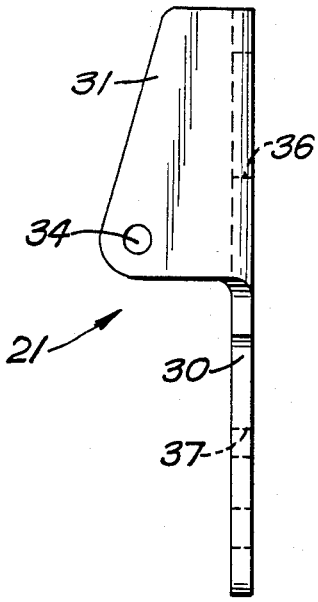
FIG. 3 is a side plan view of the bracket member shown in FIG. 2.

As shown in FIGS. 2 and 3, the bracket member 21 has, as integral parts thereof, a flat anchor plate 30 and upstanding sides 31,32 (ears). The upstanding sides 31,32 are formed at opposite sides of the flat anchor plate 30, perpendicular to plate 30, and are in imaginary parallel planes.

Each of the upstanding sides 31,33 has a bearing hole 34,35 respectively therethrough.

The flat anchor plate 30 has a first aperture 36 and a second aperture 37, as best shown in FIG. 2. Each of the apertures 36 and 37 has a flat forward wall, respectively 38,39. Each aperture 36,37 has a series of indentations which form the wall opposite the flat walls 38,39. The indentations form pairs, which are respectively 40*a*, 40*b*; 41*a*, 41*b*; 42*a*, 42*b*. The pairs of indentations are adapted to hold the screws which hold the anchor plate 30 to the panel 10.

A screw 43 having a head is shown in indentation 40*a* and a screw 44 having a head is shown in indentation 40*b*. These screws 43,44 may be loosened, which permits anchor plate 30 to be moved on the panel 10. For example, the anchor plate 30 may be moved closer to the edge of panel 10 (the edge which faces panel 11) by positioning the screws 43 and 44 in the respective indentations 42*a*, 42*b*. The indentations permit the anchor plate to be adjusted on the panel 10 without the necessity of removing the screws 43,44 and placing them in new screw holes in the panel.

Figure 4:
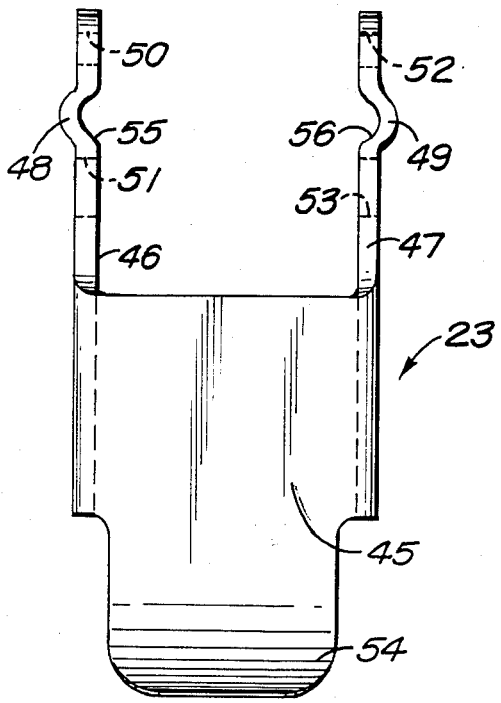
FIG. 4 is a top plan view of the lever member.
Figure 5:
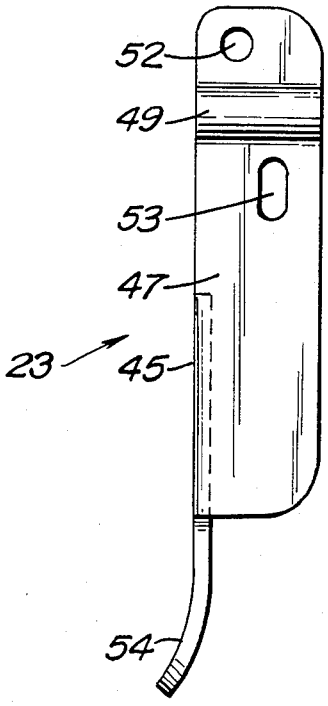
FIG. 5 is a side plan view of the lever member shown in FIG. 4.

The lever member (operable lever or handle member) as shown in FIGS. 4 and 5, is an integral member preferably formed from sheet metal. A central plate portion 45 has descending side portions 46 and 47. A curved handle portion 54 is positioned at the end of the plate portion 45. The descending side portions 46,47 are generally parallel to each other and perpendicular to the plate portion 45. Each of the side portions 46,47 has an outwardly projecting ridge, respectively 48,49. The side portion 46 has a bearing hole 50 and a slot 51. Similarly the side portion 47 has a bearing hole 52, whose imaginary center is aligned with the imaginary center of the hole 50, and a slot 53 which is aligned with the slot 51.

Figure 6:
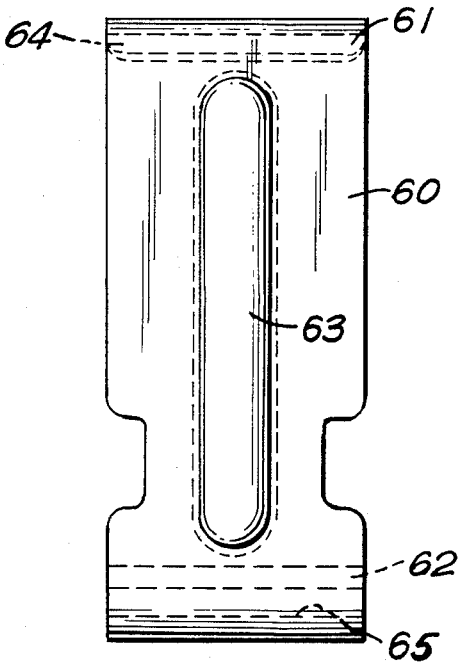
FIG. 6 is a top plan view of the pivotable hasp member.
Figure 7:
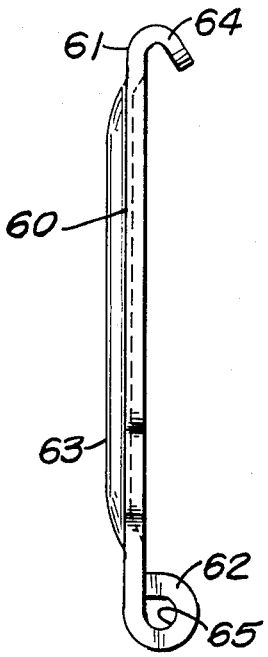
FIG. 7 is a side plan view of the pivotable hasp member shown in FIG. 6.

The pivotable member (male slide or drawbar) FIGS. 6,7, is an integral member preferably formed from sheet metal. It consists of a central portion 60, an outer lip portion 61 and an inner pivotable means portion 62. The central plate portion has an elongated raised protrusion 63, which is preferably centered as shown in FIG. 6. This protrusion 63 strengthens and stiffens the movable hasp member and is preferably rounded in cross-section. The lip portion 61 has a turned-back edge portion, for example, at about 30 degrees, forming a lip 64 which interconnects with the lip on the keeper plate. Preferably the inner pivotable means portion 62 is formed by the turned-back metal, at the end of the hasp, forming a tunnel bore 65.

The toggle latch assembly, as shown in FIGS. 1 and 8, is assembled using the pair of springs 24. Preferably the springs 24 consist of a left single-turn coiled torsion spring 25 and a right single-turn coiled torsion spring 26. Each spring 25,26 has a short free arm 25*a*,26*a*, respectively, and a longer free arm 25*b*,26*b* respectively. When assembled, as shown in FIGS. 1 and 8, the spring action of the springs 25,26 is to tend to separate arm 25*a* from arm 25*b* and similarly to separate arm 26*a* from 26*b*.

The springs are designed and manufactured in such a configuration to be contained in the assembled condition. The springs must be flexed sufficiently to absorb between them at least the minimum amount of force that the toggle lock is designed to impose. The springs, therefore, as contained in the assembly, are pre-loaded, so that when the fastener is being locked the minimum desired force must be produced by the toggle lock before the movement of the longer spring arms 25*b*,26*c* within the slots 51 and 53 can begin. Further movement of the spring arms 25*b*,26*b* in, and along, the slots 51,53 requires that the toggle lock produces somewhat more force until the spring arms finally move to the ends of the slots. Beyond this much movement the toggle lock "goes positive", i.e., cannot move more due to permitted spring action.

As shown in FIGS. 1 and 8, to assemble the toggle latch the shorter spring arm 25*a* is inserted through bearing hole 35 of the bracket 21 and also through bearing hole 50 of the lever 25. Similarly, the other shorter spring arm 26*a* is inserted through bearing hole 34 of the bracket 21 and also through bearing hole 52 of the lever. The bearing holes 50,52 are in extension arm portions 55,56 of the lever side portions 46,47. The spring arms 25*a*,26*a* act as a pivot which connects the lever 23 to the bracket 21 and permits the lever to pivot about spring arms 25*a*,26*a* at its center.

The left longer spring arm 25*b* is inserted through the slot 51 of the lever 23 and into the tunnel bore 65 (pivot means) of the pivotable hasp 22. The right longer spring arm is inserted through the slot 53 of the lever member 23 and into the opposite end of the tunnel bore 65 of the pivotable hasp. The spring arms 25*b*, 25*c* connect the pivotable hasp 22 to the lever member and permit its pivoting action. The spring arms 25*b*,26*b* spring-load the pivotable hasp 22.

In operation, when opening the toggle latch from its closed (locked) position, the operator lifts the handle portion 54 of the lever member 23, which is a clockwise movement in respect to the illustration of FIG. 8. Such lifting movement will rotate the lever member 23 until limited by the contact of the lever member's projecting ridges 48,49 with the top face of the respective bracket's upstanding sides 31,32. The lifting movement of the lever member 23 not only unlocks the pivotable hasp 22, but also lifts it from the keeper member 12. When the lever member 23, after being fully opened, is drawn back (counterlockwise movement in regard to FIG. 8) it automatically retracts the pivotable hasp 22 away from the keeper member 12. When the lever member 23 is fully retracted, and flat against the bracket 21, the pivotable hasp will be in about a vertical position.

When closing the toggle latch from its open (unlocked) position to its closed (locked)position, the operator will lift the handle portion 54 of the lever member 23, which is a clockwise movement in respect to the illustration of FIG. 8. Such lifting action brings the pivotable hasp 22 toward the keeper member 12. That lifting motion continues until the hasp 22 moves far enough, to the right in FIG. 8, so that the lip 64 of the hasp 22 is brought past, and dropped down over, lip 15 to engage the two lips 15,64; although the operator's finger may be used to touch the two lips together. When the two lips are engaged, hooking each other, the operator rotates handle portion 54 in the opposite direction (counterclockwise in FIG. 8), reversing the direction of movement of the hasp 22 and causing the keeper member 14 and bracket member 21 to be drawn toward each other. Such drawing movement continues until the bottom edges of side portions 46,47 of the lever 23 contact the top face of the bracket member 21, which is the locked position illustrated in FIG. 8.

The fastener functions to draw the keeper member and toggle latch together; for example, it draws a cover panel (fixed to the keeper member) to a container panel (fixed to the toggle latch). When the two panels are fully drawn together, and cannot be moved closer, the continued counterclockwise rotation of the lever member 23 will cause the pre-loaded spring arms to be further flexed. Such flexing causes the spring arms 25*b*,26*b* to move within the slots 52,53, the movement being to the right in FIG. 8, until the rotation of the lever member is completed by bottoming on the bracket member.

During the drawing and locking operation, when the panels cannot be drawn further together, the continued rotation of the lever member 23 moves the slots 51,53 downwardly, along an imaginary circle, centered on apertures 34,35 and 50,52, and away from the keeper plate. The hasp 22 retains the spring arms 25*b*,26*b* as the slots 51,53 continue to move away from the keeper member, until the lever member bottoms on the top of the bracket member. The slots 51,53 have moved to the left while the spring arms 25*b*,26*b* are retained by hasp 22. The keeper member and toggle latch are now spring-loaded together by the deflection of the spring arms 25*b*,25*a*.

When the fastener is to be used in its positive lock non-spring-loaded mode, the keeper member and toggle latch are installed further apart. As the slots 51,53 move relative to the retained spring arms 25*b*,26*b*, the forward edges of the slots 51,53 will contact the spring arms 25*b*,26*b*, the forward edges being toward the keeper member in FIG. 8. When such contact is made, the fastener passes from its spring-loaded mode to its positive lock non-spring-loaded mode. The toggle latch is in its positive lock mode when moving the slots 51,53 to the left engages the spring arms 25*b* on the forward edges of the slots 51,53. The continued leftward movement of the slots 51,53 directly forces the spring arms 51,53 to follow such leftward drawing movement and positively locks the fastener when the lever member bottoms on the bracket member. In the non-spring-loaded mode there is a direct, non-spring-loaded, connection between the hasp and the lever member. The spring arms still function to pivot the hasp and lever member and hold the hasp, lever member and bracket member assembled.

In both the spring-loaded and non-spring-loaded modes the locked position of the toggle latch is overcenter, in relationship to the pivoting action of the spring arms 25*b*,26*b*. Consequently, the toggle latch will remain locked until it is unlocked by a positive lifting force on the handle portion 54 of the lever 23.

The combination of the adjustable bracket, which is optional, and the spring mounting, provides an infinite number of adjustments steplessly over a wide total range, for example, over a range of 7/32 an inch. The anchor plate 30 is shown as having three pairs of indentations, but it may be made with a fewer or a greater number of pairs of indentations. Alternatively, and not shown, the bracket 21 may be non-adjustable and secured to the panel, in a fixed position, by screws, rivets or welding.

Using any pair of indentations, the latch will operate correctly, and will spring-load correctly, and will be spaced within a certain range. That range is determined by the distance that the longer spring arm 15*a*,15*b* can move within the slots 51 and 53. This range, i.e., the length of the slots 51,53, is longer than the distance adjustment between each pair of indentations and the next pair. Therefore the three (as shown), or more, ranges overlap each other so that the adjustment over the combined total range is stepless.

Once the desired location is established and tested, using the pairs of indentations, the bracket member 21 can, at the option of the user, be further and more permanently fixed as to location by installation of additional screws through the holes 66 and 67.

The toggle latch assembly of the present invention uses no pins. Instead, it uses the same pair of springs 25,26 to perform three functions; they hold the parts together, they act as pivot members, and they spring-load the pivotable hasp. By performing all three functions, as noted above, the springs not only eliminate rivets, pivots and pins, but also eliminate additional assembly operations. The entire, and only, toggle latch assembly operation is inserting the springs.

There are some applications in which spring-loading is not only unnecessary but is undesirable. Such applications require the use of non-spring-loaded or "positive" fasteners. The present invention can be used as a positive fastener by installing the bracket member a certain greater distance from the keeper plate (strike). When so installed, the toggle latch, while being locked up, first produces enough force to cause the slots 51 and 53 to move the full distance relative to the spring arms. When the spring arms contact the forward ends of the slots, the toggle latch will go positive and complete its lock-up. It will exert a positive pull on the keeper plate (strike), the same as any non-spring-loaded toggle latch.

The toggle latch of the present invention can be used either in the spring-loaded or in the positive mode without any alteration in structure. The springs, in the positive mode, do not provide spring loading, but they still perform the other two functions; holding the assembly together and acting as pivoting means.

In the spring loaded mode, the spring loading provides an automatic adjustment to overcome mounting inaccuracies. It also creates a spring pressure on the pivot point which helps to keep the fastener from becoming unlocked during rough handling and vibration.

What is claimed is:

1. A fastener to removably join first and second panels, including a fixed keeper member adapted to be connected to the first panel and a toggle latch adapted to be connected to the second panel, said toggle latch including:

a bracket member having a base plate and opposed upraised side portions, each side position having a through bearing hole;

a lever member pivotally mounted on said bracket member between its side portions and having a pivot means near one of its ends;

a pivotable hasp member having grasp means near one end to removably grasp said keeper member and having pivot means near its opposite end;

a left spring member and a right spring member each having a first inwardly extended spring arm captured in the pivot means of said pivotable hasp member, and a second inwardly extended spring arm through the bearing hole of said bracket member and the pivot means of said lever member;

wherein the spring members perform three functions; they are the only means connecting the lever member and the pivotable hasp member to the bracket member, they pivotally mount the lever member and the pivotable hasp member on the bracket member, and they spring-load the pivotable hasp member.

2. A fastener as in claim 1 wherein each of said spring members is a coiled torsion spring.

3. A fastener as in claim 1 wherein said bracket member, said lever member and said pivotable hasp member are sheet metal members.

4. A fastener as in claim 1 wherein the pivot means of the pivotable hasp member is a bent-back portion at one edge which forms a tunnel to enclose and capture said inward spring means.

5. A fastener as in claim 1 wherein said lever member has a flat plate portion and opposite side arms descending therefrom, and each side arm thereof has a slot through which the first spring arm extends and which is the lever member pivot means, and the pivot means of the pivotable hasp is positioned between said arms.

6. A fastener as in claim 5 wherein said lever member side arms have extension portions extending beyond said plate portion to form between them a space for said hasp pivot means, and said lever pivot means and slots are in said extension portions.

7. A fastener as in claim 2 wherein said left and right spring members are each a single-turn coiled torsion spring.

8. A fastener as in claim 1 wherein said bracket member base plate has a front face facing said keeper member and has two apertures each having a plurality of indentations which are staggered in relation to said front face, said indentations of said two apertures forming pairs of indentations in which screw means may be secured to hold said base plate to said panel in adjusted positions.

9. A fastener to removably join first and second panels, including a fixed keeper member adapted to be connected to the first panel and a toggle latch adapted to be connected to the second panel, said toggle latch including:

a bracket member having a base plate and opposed upraised side portions, each side portion having a through bearing hole;

a lever member pivotally mounted on said bracket member between its side portions and having opposed descending side arms with a bearing hole in each side arm;

a pivotable hasp member having grasp means near one end to removably grasp said keeper member and having pivot means comprising a bent-back end portion forming a bore;

a left coiled torsion spring member and a right coiled torsion spring member each having a first inwardly extended spring arm captured in the bore of said pivotalbe hasp member and a second inwardly extended spring arm through the bearing holes of said bracket member and said lever member;

wherein the spring members hold the toggle latch together, pivotally mount the lever member and the pivotable hasp member, and spring-load the pivotable hasp member.

10. A fastener as in claim 9 wherein said bracket member, said lever member and said pivotable hasp member are sheet metal members.

11. A fastener as in claim 9 in which the pivot means of the lever member is a pair of elongated slots, whereby the toggle latch may be spring-loaded or, alternatively, have a positive position without spring-loading.

* * * * *